US005821965A

United States Patent [19]

Oda et al.

[11] Patent Number: 5,821,965

[45] Date of Patent: Oct. 13, 1998

[54] INK SUPPLY UNIT AND RECORDER

[75] Inventors: Kazuyuki Oda; Katsuyuki Fujii; Junichi Yoshida; Katsuhide Ogawa; Ichiro Tomikawa; Jun Takagi; Yoshihiko Fujimura, all of Ebina, Japan

[73] Assignee: Fuji Xerox Co., Ltd., Tokyo, Japan

[21] Appl. No.: 601,522

[22] Filed: Feb. 14, 1996

[30] Foreign Application Priority Data

Feb. 21, 1995 [JP] Japan ..... 7-032706

[51] Int. Cl.[6] ..... B41J 2/175

[52] U.S. Cl. ..... 347/86

[58] Field of Search ..... 347/86, 87, 92; 346/140 R; 400/124.1, 471; 428/195, 323

[56] References Cited

U.S. PATENT DOCUMENTS

| | | | |
|---|---|---|---|
| 3,967,286 | 6/1985 | Anderson et al. . | |
| 4,422,084 | 12/1983 | Saito . | |
| 4,436,439 | 3/1984 | Koto . | |
| 4,719,479 | 1/1988 | Kyogoku . | |
| 4,994,824 | 2/1991 | Winslow . | |
| 5,010,354 | 4/1991 | Cowger et al. . | |
| 5,119,115 | 6/1992 | Buat et al. | 346/140 R |
| 5,158,377 | 10/1992 | Suzuki et al. . | |
| 5,409,138 | 4/1995 | Nakano . | |
| 5,509,140 | 4/1996 | Koitabashi et al. . | |
| 5,552,816 | 9/1996 | Oda et al. | 347/86 |
| 5,589,862 | 12/1996 | Ujita et al. . | |

FOREIGN PATENT DOCUMENTS

| | | |
|---|---|---|
| 0 488 829 A2 | 6/1992 | European Pat. Off. . |
| 0 529 879 A1 | 3/1993 | European Pat. Off. . |
| 0 605 183 A2 | 7/1994 | European Pat. Off. . |
| 0 727 314 A2 | 8/1996 | European Pat. Off. . |
| 0 728 586 | 8/1996 | European Pat. Off. . |
| 57-16385 | 6/1980 | Japan . |
| 57-2786 | 1/1982 | Japan . |
| 59-500609 | 4/1984 | Japan . |
| 59-95152 | 6/1984 | Japan . |
| 60-262654 | 12/1985 | Japan . |
| 61-35892 | 3/1986 | Japan . |
| 62-5994 | 1/1987 | Japan . |
| 63-231759 | 10/1987 | Japan . |
| A-63-5069 | 1/1988 | Japan . |
| 63-87242 | 4/1988 | Japan . |
| 63-276554 | 11/1988 | Japan . |
| 64-35215 | 2/1989 | Japan . |
| 1-148559 | 6/1989 | Japan . |
| 2-34354 | 2/1990 | Japan . |
| A-3-87266 | 4/1991 | Japan . |
| 3-41351 | 6/1991 | Japan . |
| 3-189157 | 8/1991 | Japan . |
| A-3-180357 | 8/1991 | Japan . |
| 4-88829 | 6/1992 | Japan . |
| 4-296566 | 10/1992 | Japan . |
| 05096744 | 4/1993 | Japan . |
| 6-238908 | 8/1994 | Japan . |
| 7-052405 | 2/1995 | Japan . |
| 7-068783 | 3/1995 | Japan . |
| 7-089088 | 4/1995 | Japan . |

OTHER PUBLICATIONS

Anonymous, "Replaceable Ink Cartridge for Ink Jet Print Head", IBM Technical Disclosure Bulletin, vol. 34, No. 1, Jun. 1991, pp. 459–462.

*Primary Examiner*—Peter S. Wong
*Assistant Examiner*—Rajnikant B. Patel
*Attorney, Agent, or Firm*—Oliff & Berridge, PLC

[57] ABSTRACT

Considering the differential pressure ΔP between pressures applied to both faces of a meniscus formation member, the differential pressure ΔP becomes the maximum when an ink supply unit is left standing with the meniscus formation member placed upward. At this time, water head PH of ink attempting to fall due to gravity is applied to the inner face of the meniscus formation member in the same direction as negative pressure PR of a capillary member. Thus, the differential pressure ΔP becomes ΔP=PR+PH. The bubble point pressure PB of the meniscus formation member is set greater than the maximum value of the differential pressure, ΔP=PR+PH, whereby air does not enter an ink tank through the meniscus formation member.

23 Claims, 11 Drawing Sheets

INK SUPPLY UNIT AND RECORDER

BACKGROUND OF THE INVENTION

This invention relates to a recorder using liquid ink, such as an ink jet printer, and an ink supply unit used with the recorder and in particular to an ink supply unit for holding ink in a negative pressure condition and easily attached to and detached from a print head section and a recorder.

In recent years, a recorder having a detachable ink supply section supplying ink to a print head section for recording in liquid ink has been developed. Such a recorder can be replenished with ink only by replacing the ink supply section. The replaced ink supply section can be manufactured at low costs for reducing the running costs of the recorder.

For example, a structure wherein when a cartridge containing ink held in a porous member is attached to a recorder, a diaphragm of a conjunction on the cartridge side is broken with a needle disposed on a print head for communication therebetween is disclosed in U.S. Pat. No. 4,436,439, U.S. Pat. No. 5,119,115, Japanese Patent Laid-Open No. Hei 3-87,266, etc. In such a structure, before the cartridge is attached, it is sealed with the diaphragm, so that ink does not leak from the conjunction and liquid coupling is intended as the cartridge is attached, thus facilitating the cartridge attaching.

However, in the structure, the inner diameter of the needle is actually made small to provide good connection at the conjunction. Thus, flow path resistance increases, a sufficient flow quantity is not obtained, and ink required for responding to high-speed printing is in short supply. In contrast, if the needle is made heavy, when the cartridge is attached, an opening is made in the diaphragm and when the cartridge is detached, ink leaks from the opening. Broken pieces of the diaphragm when the needle breaks the diaphragm on attachment of the cartridge mix into the needle or the needle is prone to be clogged with dust, etc., in the cartridge. Further, since the needle projects, if the user handles the cartridge carelessly, he or she touches the tip of the needle and is injured.

For example, a method for holding ink in a porous member and pressing an ink supply member disposed in a print head directly against the porous member for communication therebetween is disclosed in U.S. Pat. No. 5,158,377. However, this method requires an opening for inserting the ink supply member disposed in the print head into an ink tank; there is worry that ink will leak from the opening in a state in which the ink tank is detached.

On the other hand, a structure using elastic material or a vessel having bias means as described in U.S. Pat. No. 4,422,084 and a structure wherein bubbles are introduced in response to the ink consumption amount from a bubble generator disposed in a sealed housing for generating a negative pressure condition as described in Japanese Patent Laid-Open No. Hei 3-180,357 are known as means for holding ink and giving negative pressure in addition to the capillary member such as a porous substance as mentioned above. However, the documents show the structure integral with the print head and do not show a structure detachable from a print head.

SUMMARY OF THE INVENTION

It is therefore an object of the invention to provide an ink supply unit for preventing air from entering the inside thereof even if the ink supply unit is detached and left standing in any position and a recorder using the ink supply unit.

According to the invention, there is provided an ink supply unit comprising a storage section for storing ink in a negative pressure condition, an exit communicating with the storage section for supplying ink to an outside, and a meniscus formation member disposed on the exit, wherein when negative pressure generated by the storage section is PR, bubble point pressure of the meniscus formation member is PB, a water head of ink acting on a storage section side surface of the meniscus formation member is PH, and an inward differential pressure acting on both surfaces of the meniscus formation member is $\Delta P$, $\Delta P = PR + PH$ and relation $PB > \Delta P$ is satisfied.

In the ink supply unit, the storage section includes a porous member for generating the negative pressure by a capillary force of the porous member.

In the ink supply unit, the storage section includes a housing and a bubble generator disposed in the housing for generating the negative pressure by bubble point pressure of the bubble generator.

In the ink supply unit, the storage section includes a moving member for storing ink, the moving member operating so as to maintain internal negative pressure.

In the ink supply unit, the exit can be joined to a print head and can be sealed liquidly when it is joined to the print head.

In the ink supply unit, the meniscus formation member is selected from the group of a mesh substance, a filter of a fabric, resin fiber, and a filter having a highly precise opening diameter.

In the ink supply unit, the bubble point pressure of the meniscus formation member is set so as to satisfy relation $PB \geqq PR + PH$.

In the ink supply unit, the porous member is made of polyester felt, a density thereof ranging from 0.06 $g/cm^3$ to 0.1 $g/cm^3$.

In the ink supply unit, the meniscus formation member is an SUS tatami twill filter having a filter particle size ranging 5 $\mu$m to 60 $\mu$m or so.

According to the invention there is provided an ink recorder comprising:

a main ink chamber having an atmospheric communication port communicating with an external atmosphere, a communication hole for supplying ink, and a first meniscus formation member being disposed on the communication hole and formed with minute holes, the main ink chamber being capable of storing ink in a negative pressure condition;

a secondary ink chamber being sealed and having a joint part communicating with the communication hole and a second meniscus formation member being disposed on the joint part and formed with minute holes; and a print head connected to the joint part for spouting ink, wherein when negative pressure generated in the main ink chamber is PR, bubble point pressure of the second meniscus formation member is PB, and a water head of ink acting on a main ink chamber side surface of the first meniscus formation member is PH, relation $PB \geqq PR + PH$ is satisfied.

In the ink recorder, the main ink chamber includes a porous member for generating the negative pressure by a capillary force of the porous member.

In the ink recorder, the meniscus formation member is selected from the group of a mesh substance, a filter of a fabric, resin fiber, and a filter having a highly precise opening diameter.

In the ink recorder, the bubble point pressure of the meniscus formation member is set so as to satisfy relation PB≧PR+PH.

According to the invention, there is provided a recorder comprising a print head and an ink supply unit each with a joint part enabling them to be separated, characterized in that the ink supply unit comprises a storage section for storing ink in a negative pressure condition, an exit communicating with the storage section for supplying ink to an outside, and a meniscus formation member disposed on the exit, wherein when negative pressure generated by the storage section is PR, bubble point pressure of the meniscus formation member is PB, a water head of ink acting on a storage section side surface of the meniscus formation member is PH, and an inward differential pressure acting on both surfaces of the meniscus formation member is ΔP, ΔP=PR+PH and relation PB>ΔP is satisfied.

In the recorder, the storage section includes a porous member for generating the negative pressure by a capillary force of the porous member.

In the recorder, the meniscus formation member is a fabric.

In the recorder, the bubble point pressure of the meniscus formation member is set so as to satisfy relation PB≧PR+PH.

In the recorder, the porous member is made of polyester felt, a density thereof ranging from 0.06 g/cm$^3$ to 0.1 g/cm$^3$.

In the recorder, the meniscus formation member is an SUS tatami twill filter having a filter particle size ranging 5 μm to 60 μm or so.

According to the invention, when negative pressure generated by the storage section is PR, bubble point pressure of the meniscus formation member disposed on the exit is PB, a water head of ink acting on the storage section side surface of the meniscus formation member is PH, and an inward differential pressure acting on both surfaces of the meniscus formation member is ΔP, ΔP=PR+PH and relation PB>ΔP is satisfied.

When the ink supply unit is detached from the recorder and is left standing, atmospheric pressure is applied to the outer face of the meniscus formation member. The ink water head PH and the negative pressure PR occurring in the storage section together with the atmospheric pressure act on the inner face of the meniscus formation member. The negative pressure PR occurring in the storage section always acts in the direction toward the storage section from the inner face of the meniscus formation section. The ink water head is always a force toward the gravity direction. That is, when the ink supply unit is left standing with the meniscus formation member placed downward, a force acts on the inner face of the meniscus formation member in a direction opposite to the storage section; force is applied in the opposite direction to the negative pressure in the storage section. When the ink supply unit is left standing with the meniscus formation member placed upward, a force acts on the inner face of the meniscus formation member in a direction toward the storage section; force is applied in the same direction as the negative pressure in the storage section. Considering the differential pressure ΔP between pressures applied to both faces of the meniscus formation member, when the ink supply unit is left standing with the meniscus formation member placed upward, the differential pressure ΔP becomes the maximum, namely, the sum of the negative pressure PR in the storage section and the water head PH or ΔP=PR+PH.

To prevent air from entering the ink supply unit through the meniscus formation member, if the ink supply unit is left standing with the meniscus formation member pointed upward, the inner face of the meniscus formation member may be provided with a force in an opposite direction competing with the force applied in the direction toward the storage section. The meniscus formation section is formed with meniscuses and when the ink meniscuses are pressed by air, the surface tension against the force acts. The pressure when air overcomes the surface tension and enters the ink supply unit is called bubble point pressure. If the bubble point pressure PB is greater than the maximum value of the differential pressure ΔP=PR+PH, no air enters the ink supply unit. That is, since the bubble point pressure PB of the meniscus formation member is set so that bubble point pressure PB>differential pressure ΔP, no air enters the ink supply unit even if the ink supply unit is left standing with the meniscus formation member pointed upward.

The storage section of the ink supply unit may include a porous member, a bubble generator, or a moving member for storing ink. The exit of the ink supply unit can be sealed liquidly when it is joined to a print head. Further, the meniscus formation member can be made of a fabric.

DETAILED DESCRIPTION OF THE PREFERRED EMBODIMENTS

Referring now to the accompanying drawings, there are shown preferred embodiments of the invention.

Figure 1:
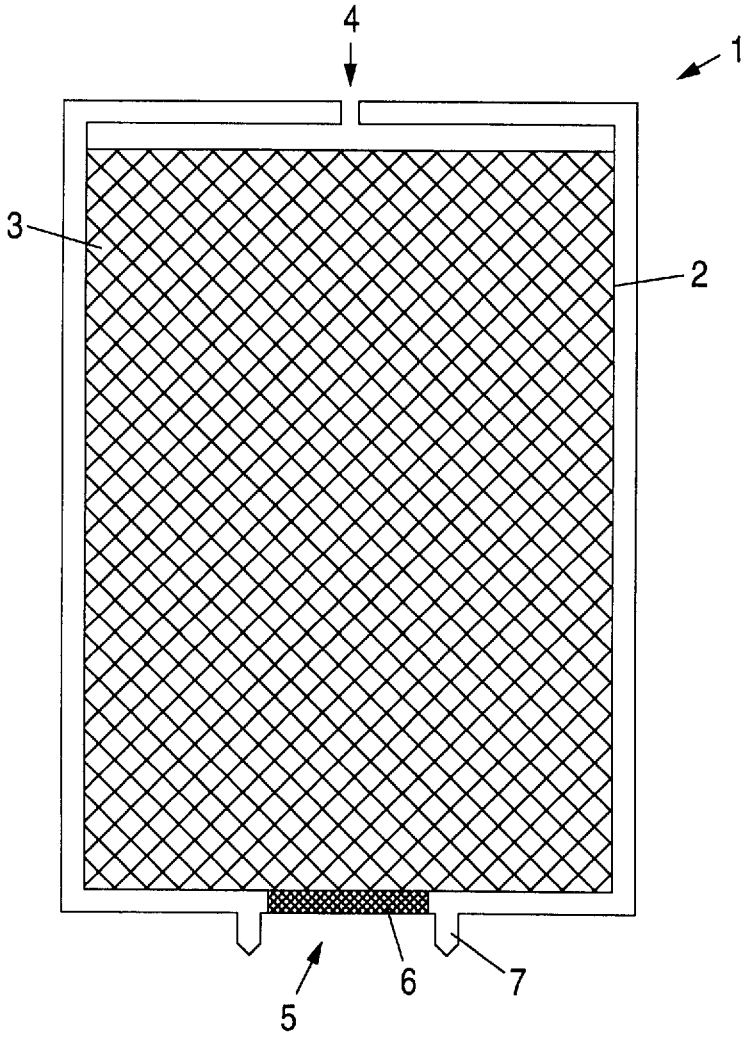
FIG. 1 is a schematic structural drawing showing a first embodiment of an ink supply unit of the invention.

FIG. 1 is a schematic structural drawing showing a first embodiment of an ink supply unit of the invention, wherein numeral 1 is an ink tank, numeral 2 is an ink chamber, numeral 3 is a capillary member, numeral 4 is an atmospheric communication hole, numeral 5 is a joint port, numeral 6 is a meniscus formation member, and numeral 7 is a protrusion.

The ink tank 1 contains the ink chamber 2 and is formed with the atmospheric communication hole 4 on the top and the joint port 5 for deriving ink on the bottom. It is connected to a print head (not shown) at the joint port 5. At this time, the protrusions 7 are pressed against, for example, an elastic member of the print head (not shown) for sealing the connection part, forming a liquid communication passage. Of course, the ink tank 1 may be provided with an elastic member in place of the protrusions 7 and the print head may be formed with protrusions in place of the elastic member.

The capillary member 3 is placed in the ink chamber 2 for holding ink and maintaining negative pressure by a capillary force. Ink in the ink chamber 2 is supplied via the joint port 5 to the print head. When ink is supplied to the print head, the negative pressure generated by the capillary member 3 prevents the ink from leaking from the print head, maintains print conditions, and holds the print quality.

The atmospheric communication hole 4 is a hole for taking an atmosphere into the ink chamber 2. The capillary member 3 communicates with the taken-in atmosphere on the top and is released with the atmospheric pressure. When ink is supplied to the print head, the ink in the capillary member 3 is pressed by the atmospheric pressure and is derived from below the capillary member 3 by negative pressure generated by the print head, so that it can be used efficiently. At this time, the negative pressure in the print head is held constant by the capillary force of the capillary member 3.

The meniscus formation member 6 formed with a large number of minute holes is placed in the joint port 5. The bottom of the capillary member 3 comes in contact with, and preferably is pressed into contact with, the meniscus formation member 6 for placement. The meniscus formation member 6 can use a mesh substance such as a wire net or resin net, a porous substance, etc., for example. A metal mesh filter, a filter using as a base material a substance comprising metal fibers, for example, SUS fine wires formed like felt and further compressed and sintered, an electroforming metal filter, etc., can be used as specific examples of the mesh substance. For example, a filter of a fabric of metal or resin fibers like tatami twill or a filter having a highly precise opening diameter made by laser beam machining, electron beam machining, etc., can be used.

When the ink tank 1 is attached to a recorder, the meniscus formation member 6 serves as a filter in the ink flow path for preventing dust or bubbles from entering the print head. When the ink tank 1 is detached, the ink held in the capillary member 3 forms meniscuses in the minute openings of the meniscus formation member 6 for preventing ink leakage. As described below, the entry of air from the meniscus formation member 6 is also prevented.

Figure 2:
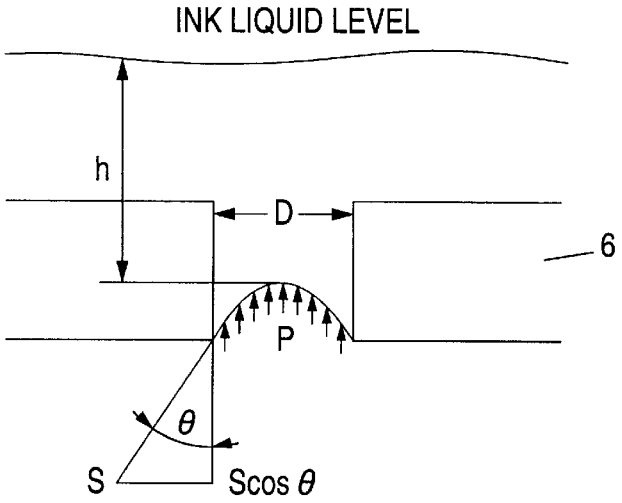
FIG. 2 is an illustration of a meniscus formed in a meniscus formation member 6.

FIG. 2 is an illustration of a meniscus formed in the meniscus formation member 6, wherein only one opening of the meniscus formation member 6 is shown. If the meniscus formation member 6 is submerged in ink and internal pressure of the filter is applied, the meniscus formed in the opening is pushed and dented, as shown in FIG. 2. As the internal pressure is increased gradually, the dent of the meniscus is growing by degrees. When the internal pressure reaches a certain pressure, bubbles occur on the ink. This pressure is called bubble point pressure.

Assume that the meniscus formation member 6 is submerged in ink to depth h and that internal pressure p is applied, as shown in FIG. 2. Assume at this time that a meniscus of ink as shown in FIG. 2 is formed in the opening. At this time, force FS caused by the interfacial tension on the ink meniscus acts in a direction running counter to pressure force FP directed from bottom to top in the figure. In addition, a force received from the ink, Fh, acts in a direction directed from top to bottom in the figure. The relationship among the forces is represented by expression FS=FP−Fh. Assuming that the ink interfacial tension is S, that the ink density is γ, that the wet angle is θ, and that the opening diameter is D, it is known that the expression can be represented as follows:

$$S\pi D\cos\theta = P\pi D^2/4 - \gamma\pi D^2 h/4$$

If this is solved with respect to pressure P, $$P = 4S\cos\theta/D - \gamma h$$

when h≈0, $$P = 4S\cos\theta/D$$

The bubble point pressure is determined from the opening diameter D, the wet angle θ, and the ink interfacial tension S.

Figure 3A:
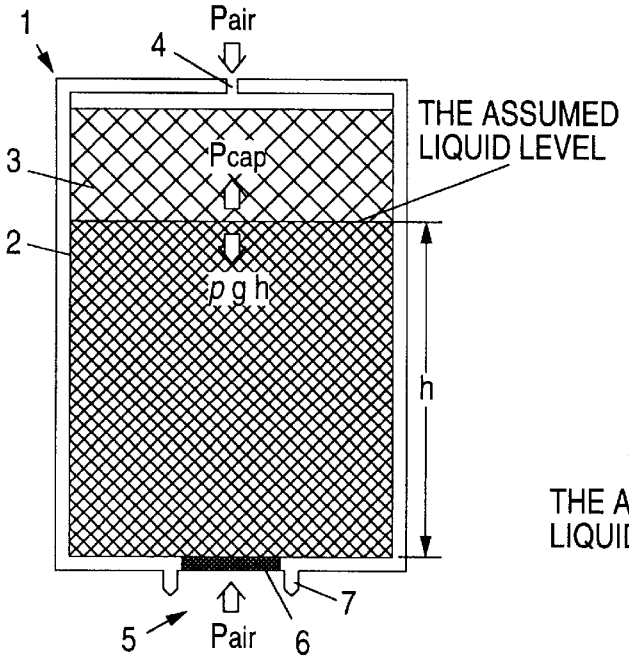
FIGS. 3A and 3B are illustration of pressure applied to the meniscus formation member when the ink supply unit is left standing in the first embodiment of the ink supply unit of the invention.
Figure 3B:
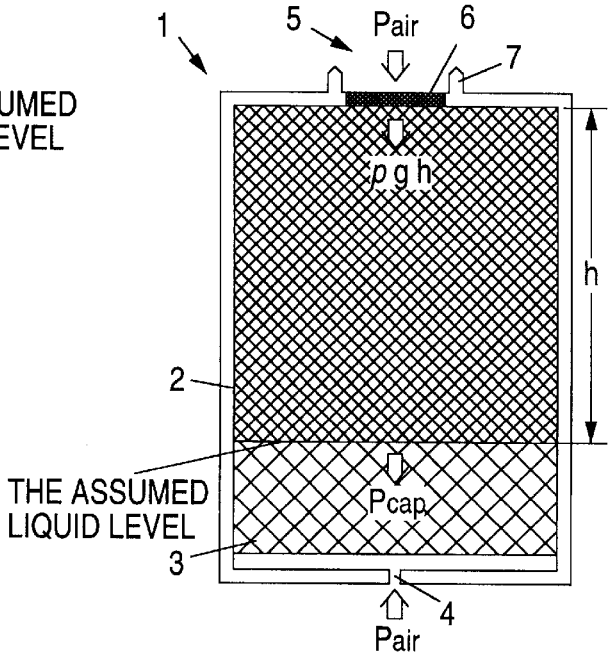

FIGS. 3A and 3B are illustrations of pressure applied to the meniscus formation member when the ink supply unit is left standing in the first embodiment of the ink supply unit of the invention. The pressure state in the first embodiment of the invention shown in FIG. 1 will be considered. FIG. 3A shows a state in which the ink tank 1 is detached from the recorder and is left standing with the meniscus formation member 6 positioned on the bottom. The capillary member 3 is impregnated with ink for forming the assumed liquid level shown in the figure. At this time, the capillary member 3 is released to the atmosphere through the atmospheric communication hole 4. Thus, the assumed liquid level receives the atmospheric pressure. Let the atmospheric pressure in the ambient atmosphere at this time be $P_{air}$. Further, the capillary force of the capillary member, namely, upward pressure $P_{cap}$ produced by the interfacial tension between the ink and the capillary member occurs on the liquid level. Assuming that the vertical distance from the meniscus formation member 6 existing on the bottom face of the ink tank 1 to the assumed liquid level is h, the water head of ink, pgh, is applied to the meniscus formation member 6 outward, where p is the ink density and g is a gravity constant. In summary, the pressure acting on the ink tank side surface of the meniscus formation member 6 becomes $P_{air}-(P_{cap}-pgh)$.

The pressure acting on the outer surface of the meniscus formation member 6 is $P_{air}$, atmospheric pressure. Thus, assuming that the differential pressure acting on both surfaces of the meniscus formation member 6 is ΔP, $$\begin{aligned}\Delta P &= P_{air} - \{P_{air} - (P_{cap} - pgh)\} \\ &= P_{cap} - pgh\end{aligned}$$

This differential pressure ΔP acts in the direction of pulling the ambient air into the ink tank 1 and is a force corresponding to the pressure P from bottom shown in FIG. 2 mentioned above. The capillary force of the capillary member 3 is set so that ΔP always becomes positive to always hold the ink pressure supplied to the print head at negative pressure.

In such a state, to prevent the ambient air from entering the ink tank, the bubble point pressure PB of the meniscus formation member with ink may always be PB>ΔP.

In this case, the bubble point pressure PB of the meniscus formation member with ink is defined. However, it may be possible to satisfy the above relation by adjusting negative pressure due to reducing the capillary force of the felt.

Next, the case where the ink tank 1 is placed in an inverted position and is left standing so that the meniscus formation member 6 becomes the top face as shown in FIG. 3B will be considered. In this case, the pressure acting on the outer surface of the meniscus formation member 6 remains $P_{air}$, atmospheric pressure. However, the force acting on the ink tank 1 side surface of the meniscus formation member 6 changes from the direction in which the pressure caused by the ink gravity presses the meniscus formation member 6 to the direction in which it pulls the meniscus formation member 6. Thus, the pressure acting on the ink tank side surface of the meniscus formation member 6 becomes $P_{air}-(P_{cap}+pgh)$.

Thus, assuming that the differential pressure acting on both surfaces of the meniscus formation member 6 is ΔP, $$\begin{aligned}\Delta P &= P_{air} - \{P_{air} - (P_{cap} + pgh)\} \\ &= P_{cap} + pgh\end{aligned}$$

As this differential pressure ΔP, the force stronger by 2 pgh as compared with the case in FIG. 3A above acts in the direction of pulling the ambient air into the ink tank 1.

Considering the relationship with the remaining ink amount, the altitude difference of the assumed liquid level, h, becomes the maximum when the package of the ink tank 1 is opened. When the user places the ink tank in an inverted position and the meniscus formation member 6 comes to the top of the ink tank 1, the differential pressure reaches the maximum; the differential pressure of $\Delta P_{max}=P_{cap}+pgh_{max}$ acts on both surfaces of the meniscus formation member. To also prevent the entry of air at the time, a fine meniscus formation member 6 having the bubble point pressure PB satisfying $$PB>\Delta P_{max}=P_{cap}+pgh_{max}$$

may be installed. If the meniscus formation member having the bubble point pressure PB satisfying such a condition is used, when the ink tank 1 is detached with remaining ink, PB>ΔP is always satisfied and the entry of air can be prevented. Of course, if the ink tank is placed in the state in FIG. 3A, air is not entered.

Figure 4:
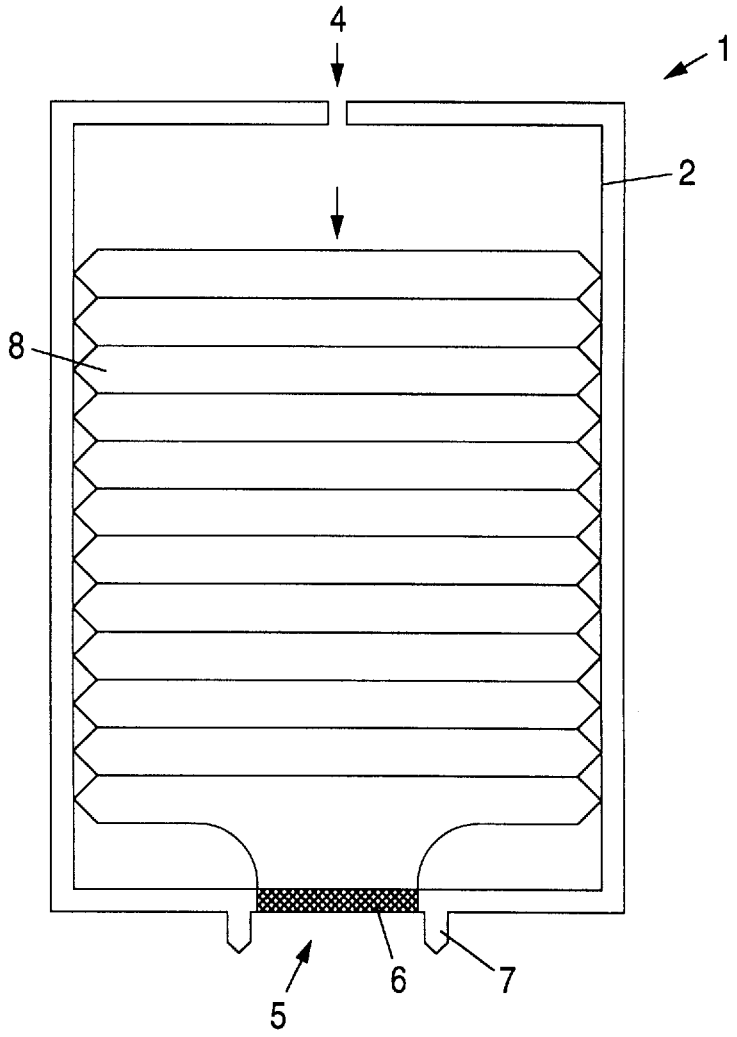
FIG. 4 is a schematic structural drawing showing a second embodiment of an ink supply unit of the invention.

FIG. 4 is a schematic structural drawing showing a second embodiment of an ink supply unit of the invention. Parts identical with or similar to those previously described with reference to FIG. 1 are denoted by the same reference numerals in FIG. 4 and will not be discussed again. In FIG. 4, numeral 8 is moving means. In the second embodiment, the moving means 8 is used as an ink chamber in an ink tank 1. It is a sealed vessel like a bellows and is filled with ink. As the ink is consumed, the moving means 8 shrinks downward, but a force always acts in the upward expanding direction, maintaining the internal negative pressure condition.

In the embodiment, when the ink tank 1 is detached and left standing, the maximum value of the differential pressure applied to both surfaces of a meniscus formation member 6, $\Delta P_{max}$, is also the sum of negative pressure $P_{cap}$ occurring in the moving means 8 and the maximum value of the water head of the ink, $pgh_{max}$, as in the first embodiment. As the meniscus formation member 6, a member whose bubble point pressure PB satisfies $PB>\Delta P_{max}$ may be used.

Figure 5:
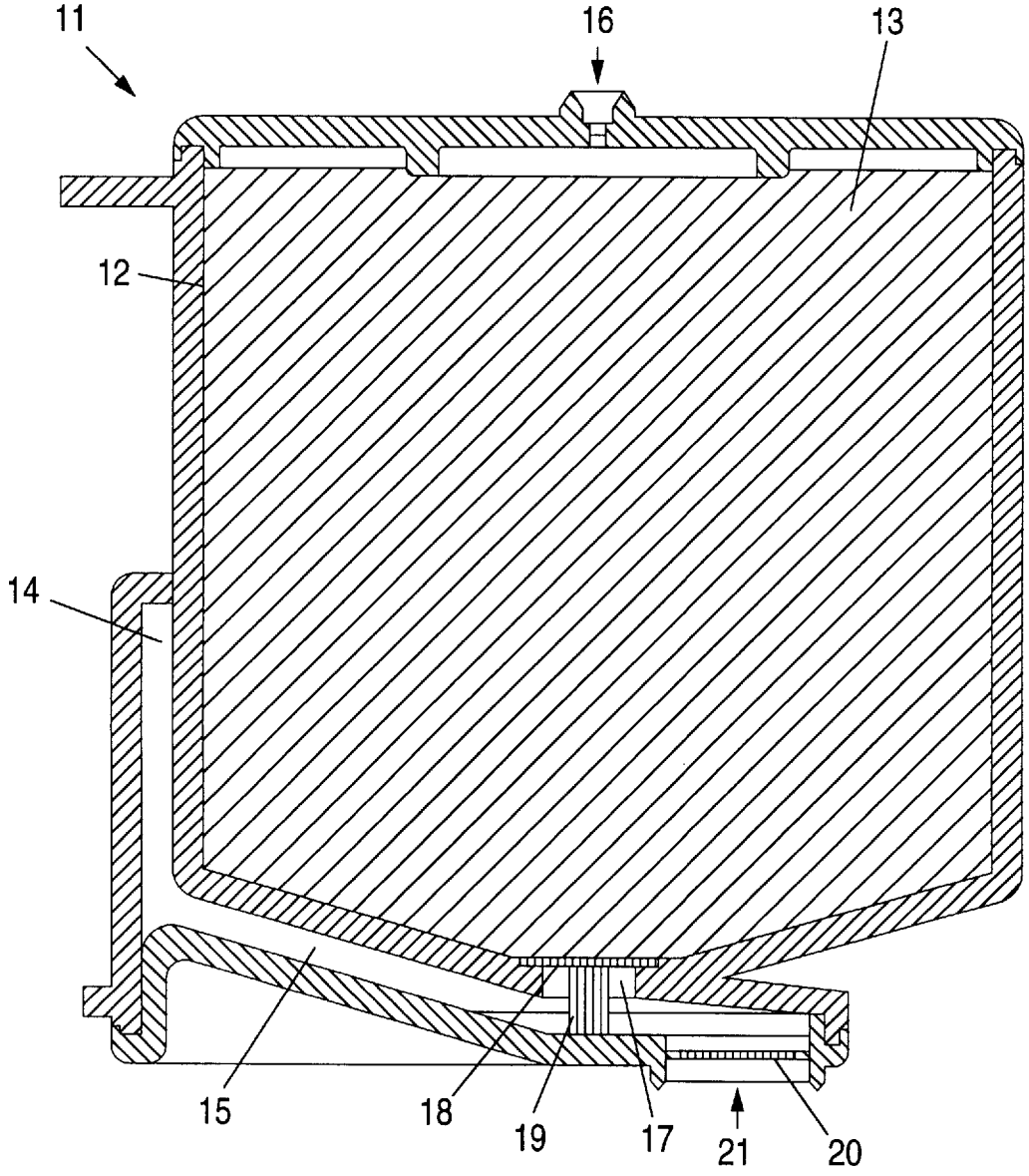
FIG. 5 is a sectional view showing a third embodiment of an ink supply unit of the invention.
Figure 6:
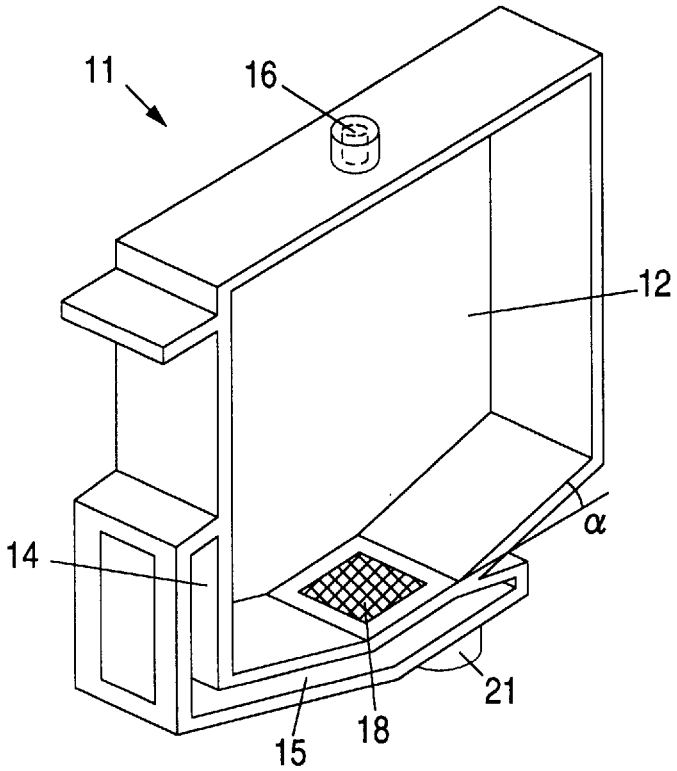
FIG. 6 is a perspective view in section showing the third embodiment of the ink supply unit of the invention.

FIG. 5 is a sectional view showing a third embodiment of an ink supply unit of the invention. FIG. 6 is a perspective view in section showing the third embodiment of the ink supply unit of the invention. In the figures, numeral 11 is an ink tank, numeral 12 is a main ink chamber, numeral 13 is a capillary member, numeral 14 is an intermediate ink chamber, numeral 15 is a communication passage, numeral 16 is an atmospheric communication port, numeral 17 is a communication hole, numeral 18 is a first meniscus formation member, numeral 19 is an ink supply section, numeral 20 is a second meniscus formation member, and numeral 21 is a joint port. This embodiment shows a specific example of the 2-chamber ink supply unit. In FIG. 6, the side wall on the front and the capillary member 13 are excluded.

The ink tank 11 contains the main ink chamber 12 and the intermediate ink chamber 14 on the side thereof. A material which has rigidity and is good in ink resistance for enabling long-term ink holding is selected for the cabinet of the ink tank 11. The ink tank 11 is connected to a print head, (not shown) at the joint port 21. Ink in the main ink chamber 12 passes through the communication passage 15 and is supplied via the joint port 21 to the print head.

The communication hole 17 is made in the bottom of the main ink chamber 12, which communicates with the intermediate ink chamber 14 and the joint port 21 via the communication passage 15. The communication hole 17 can be shaped in cross section like a circle, an ellipse, a polygon, a star, a cross, a slit, or the like. The bottom face of the main ink chamber 12 is formed as a slope having angle α such that the communication hole 17 is the lowest part.

The capillary member 13 is placed in the main ink chamber 12 for holding ink by a capillary force and maintaining negative pressure. It can be made of a fiber material having a two-dimensional structure, a porous material having a three-dimensional structure, felt comprising a fiber material spun into a three-dimensional form, a nonwoven cloth material, or the like. Specifically, for example, polyester felt comprising polyester fibers spun into a three-dimensional form can be used as the material of the capillary member 13. A material having a density of 0.06 $g/cm^3$–0.1 $g/cm^3$ can be used; a material having a density of the order of such value is preferred from the viewpoints of the capillary force and fluid resistance with respect to ink. The material is not limited to polyester fibers and any other material can be used in accordance with ink if it has a proper capillary force and resists ink.

The surrounding shape of the capillary member 13 is the same as the inside shape of the main ink chamber 12 and the capillary member 13 is inserted into the main ink chamber 12 so that the surroundings of the former come in intimate contact with the side walls of the latter, thereby preventing air introduced from the atmospheric communication hole 16 from entering the main ink chamber 12 along the side walls thereof. The bottom face of the capillary member 13 is formed with a slope having a larger lean than the lean α of the slope made on the bottom face of the main ink chamber 12. Further, only the portion of the capillary member 13 coming in contact with the first meniscus formation member 18 is formed convexly. The capillary member 13 of such a shape is inserted into the main ink chamber 12 so as to come in contact with the whole bottom face of the main ink chamber 12. Then, it is crushed particularly on the first meniscus formation member 18 and the density of the capillary member 13 raises, and lowers gradually with distance from the first meniscus member 18, thereby furthermore blocking air attempting to pass between the inner face of the main ink chamber 12 and the capillary member 13 and enter the main ink chamber 12 for decreasing the amount of air arriving at the surface of the first meniscus formation member 18 in a state in which ink remains in the main ink chamber 12. A structure wherein the capillary member 13 is not pressed into contact with the first meniscus formation member 18 is also possible, but the capillary member 13 needs at least to be in contact with the first meniscus member 18.

The atmospheric communication port 16 through which the capillary member 13 can communicate with the atmosphere is made in the top of the main ink chamber 12. In the embodiment, the diameter of the atmospheric communication port 16 is made larger than the hole of the capillary member 13 or the gap between fibers. The capillary member 13 communicates with the atmosphere on the top and is released with the atmospheric pressure. When ink is supplied to the print head, the ink in the capillary member 13 is pressed by the atmospheric pressure and is derived from below the capillary member 13 to the communication passage 15 by negative pressure, so that it can be used efficiently. At this time, the negative pressure in the print head is held constant by the capillary force of the capillary member 13. The atmospheric communication port 16 can also be provided with a sheet not passing ink and allowing air to pass through so that ink do not jump out of the atmospheric communication hole 16. Alternatively, it can also be formed with a large number of minute holes through which ink does not flow out.

The first meniscus formation member 18 is placed on the communication hole 17 made in the bottom face of the main ink chamber 12. The bottom of the capillary member 13 is pressed into contact with the first meniscus formation member 18 for placement. The first meniscus formation member 18 can use a mesh substance such as a wire net or resin net, a porous substance, etc., for example. A metal mesh filter, a filter using as a base material a substance comprising metal fibers, for example, SUS fine wires formed like felt and further compressed and sintered, an electro forming metal filter, etc., can be used as specific examples of the mesh substance. For example, a filter of a fabric of metal or resin fibers like tatami twill or a filter having a highly precise hole diameter made by laser beam machining, electron beam machining, etc., can be used. The form is a circle, a rectangle, or any other form if it can cover the communication hole 17.

When the capillary member 3 is impregnated with ink, the ink passes through the first meniscus formation member 18 and moves to the intermediate ink chamber 14. The first meniscus formation member 18 also prevents unnecessary air from entering the intermediate ink chamber 14 if the capillary member 13 becomes empty of ink. When the ink is furthermore consumed, air coming in through the atmospheric communication port 16 passes through the capillary member 13, pushes meniscuses of ink covering the minute holes made in the first meniscus formation member 18 in contact with the capillary member 13 by an increase in negative pressure in the main ink chamber 12, overcomes the surface tension, and passes through the meniscuses, forming bubbles. The bubbles moves through the communication passage 15 to the intermediate ink chamber 14. The pressure when the bubbles occur (bubble point pressure) depends on the filter particle size of the first meniscus formation member 18. The filter particle size is made optimum, whereby the negative pressure in the ink tank 11, namely, the ink supply pressure to the print head can be held constant. The filter particle size of the first meniscus formation member 18 can range from 40 $\mu$m to 70 $\mu$m or so, for example.

The ink supply section 19 is placed on the lower face of the first meniscus formation member 18 so as to come in contact with the lower face. It has a cross-sectional dimension smaller than the diameter of the communication hole 17. If bubbles collect on the lower face of the first meniscus formation member 18 and an air layer is formed or the main ink chamber 12 becomes empty of ink and the ink level becomes lower than the height of the communication passage 15, the ink supply section 19 sucks up the ink from the bottom of the communication passage 15 and supplies it to the first meniscus formation member 18, whereby the first meniscus formation member 18 can always be kept in a wet condition and negative pressure can be maintained, whereby the best condition can be maintained until all ink is consumed. The ink supply section may be of any form like a slit, a rectangular parallelopiped, a prism such as a triangle pole, a cylinder, or an elliptic cylinder. More than one ink supply section 19 can also be provided. The ink supply section 19 may be made of any material if the material is capable of pulling up ink to the first meniscus formation member 18 by a capillary force; for example, a filling material comprising polyester fibers bundled in one direction, a porous member of polyurethane, melamine foam, etc., or a two- or three-dimensional fiber structure can be used.

The ink supply section 19 can be attached directly to the first meniscus formation member 18 or can also be fixed by a rib from the side wall of the communication hole 17. Alternatively, a part of the first meniscus formation member 18 may be extended to the bottom face of the communication passage 15 as the ink supply section 19.

The intermediate ink chamber 14, the main ink chamber 12, and the joint port 21 are made to communicate with each other in order via the communication passage 15. The upper wall of the communication passage 15 may be made flat; it can be slanted so as to gradually raise toward the intermediate ink chamber 14, whereby bubbles occurring in the joint port 21 or the communication hole 17 can be moved smoothly to the intermediate ink chamber 14. Although the slant is made only in the section connecting the intermediate ink chamber 14 and the main ink chamber 12, the top face of the section connecting the main ink chamber 12 and the joint port 21 can also be slanted for smoothly moving to the intermediate ink tank 14, bubbles introduced from the joint port 21 when the ink tank 11 is attached to a recorder. The bottom face of the communication passage 15 may be flat; in the embodiment, it is formed so that the side to the intermediate ink chamber 14 raises and that the joint port 21 becomes the lowest part to reduce the remaining ink amount as much as possible.

The intermediate ink chamber 14 is filled with ink in the initial state. Bubbles passing through the first meniscus formation member 18 from the main ink chamber 12 and entering the communication passage 15 and bubbles introduced from the joint port 21 when the ink tank 11 is attached to the recorder are collected. The intermediate ink chamber 14 may be sized to enable collection of bubbles entered on rare occasion by the time the main ink chamber 12 becomes empty of ink; it can be made of a small chamber. To collect bubbles, the top face of the intermediate ink chamber 14 needs to be formed so as to become above the communication hole 17 of the main ink chamber 12. Since the air amount in the intermediate ink chamber 14 increases rapidly after the main ink chamber 12 becomes empty of ink, a window for observing it can be disposed on a side face of the intermediate ink chamber for knowing the remaining ink amount.

The joint port 21 is formed with the second meniscus formation member 20, which serves like the meniscus formation member 6 in the first or second embodiment. In a state in which the ink tank 11 is detached and left standing, surface tension of ink formed in minute holes made in the second meniscus formation member 20 prevents ink in the intermediate ink chamber 14 and the communication passage 15 from leaking from the joint port 21. When the ink tank 11 is attached to a recorder, air remaining in the joint port 21 due to pressure at the attaching time is passed through an ink film of the second meniscus formation member 20 and is moved to the intermediate ink chamber 14. Thus, the mixing of bubbles into the print head can be reduced. Further, when the ink tank 11 is attached, the second meniscus formation member 20 functions as a filter having a fine filter particle size for removing dust and foreign substance contained in the ink in the ink tank 11 and also preventing vibration and shock applied to the ink tank 11, pressure fluctuation caused by acceleration, and the mixing of bubbles from the nozzle of the print head.

A mesh substance such as a wire net or resin net, a porous substance, etc., can be used as a material of the second meniscus formation member 20 like the first meniscus formation member 18. A metal mesh filter, a compressed sintered substance filter of metal fibers, and an electro forming metal filter can be used as specific examples of the mesh substance. For example, a filter of a fabric of metal or resin fibers like tatami twill or a filter having a highly precise hole diameter made by laser beam machining, electron beam machining, etc., can be used.

As described above, the second meniscus formation member 20 can prevent ink leakage when the ink tank 11 is detached and left standing, and can also prevent the entry of air into the ink tank 11. Particularly, when ink is held in the capillary member 13 in the main ink chamber 12, the first meniscus formation member 18 functions as a filter and the main ink chamber 12, the communication passage 15, and the intermediate ink chamber 14 communicate with each other liquidly. Thus, although the ink tank 11 is of a 2-chamber structure, the bubble point pressure PB of the second meniscus formation member 20 may be set so as to be greater than the differential pressure $\Delta P_{max}$ at the full ink time applied to both surfaces of the second meniscus formation member 20 placed in the joint port 21, namely, satisfy the relation of $PB>\Delta P_{max}$, as in the first embodiment. If such relation is satisfied, air is not entered from the second meniscus formation member 20 even if the ink tank 11 shown in FIG. 5 is left standing in an inverted position. The meniscus filter particle size of the second meniscus formation member 20 is defined from the bubble point pressure, interfacial tension with used ink, and wet angle, as described above; specifically, it can range from 5 $\mu$m to 60 $\mu$m or so.

An absorption member can also be provided so that ink deposited on the joint port 21 does not drop when the ink tank 11 is detached. A material excellent in absorption power is used as the absorption member; for example, it can be made of a sponge, a filling material comprising polyester fibers bundled in one direction, or the like. It is desirable that the absorption member is low in flow path resistance. It can also be disposed in the recorder to which the ink tank 11 is attached.

Next, the operation in the third embodiment of the invention will be discussed. In the initial state, the main ink chamber 12 is filled with ink to the limit of ink that can be held by the capillary force of the capillary member 13. It is desirable as the use start condition that the main ink chamber 12 is filled with ink as much as possible from the viewpoint of ink use efficiency. However, the capillary member 13 requires a reasonable portion filled with no ink to generate negative pressure by the capillary force of the capillary member 13. The generated negative pressure can be about −20 $mmH_2O$ in the initial state, for example. The intermediate ink chamber 14 is filled with ink. Ink in the intermediate ink chamber 14 and the communication passage 15 also becomes negative pressure, which is held by an ink interface formed in the minute holes of the second meniscus formation member 20. Before use, an airtight seal can be put on the joint port 21 and the atmospheric communication port 16. In this state, the ink tank 11 is packaged. To use the ink tank 11, the airtight seal is peeled off before the ink tank 11 is attached to a recorder.

If the second meniscus formation member 20 is placed in an upward direction with the airtight seal peeled off, the differential pressure on both surfaces of the second meniscus formation member 20 becomes the maximum. However, the bubble point pressure PB of the second meniscus formation member 20 is set greater than the maximum differential pressure $\Delta P_{max}$ applied to both surfaces of the second meniscus formation member 20, as described above, so that air does not enter the inside from the second meniscus formation member 20. In contrast, if the second meniscus formation member 20 is placed in a downward direction, internal ink does not leak out. Of course, this also applies when the ink tank 11 is detached and left standing after ink in the ink tank is consumed.

When the ink tank is attached to a recorder, the joint port 21 abuts an elastic substance, etc., of the recorder, forming a sealed flow path. At the time, air remains in the joint port 21 and pressurization is applied at the sealing time. The pressurization at the sealing time exceeds the bubble point pressure, thereby pushing up the ink interface formed in the second meniscus formation member 20 and taking the air remaining in the joint port 21 into the communication passage 15 as bubbles. The bubbles entering the communication passage 15 arrive at the top face of the communication passage 15 by the buoyant force of the bubbles. Since the top face of the communication passage 15 is made a slope to the intermediate ink chamber 14, the taken-in bubbles move to the intermediate ink chamber 14 and are collected therein. Thus, the air amount remaining in the joint port 21 is reduced and the suction amount at the initial priming time is decreased.

When printing is started after the ink tank 11 is attached, ink is consumed at the print head. Then, as much air as ink that is consumed gradually spreads into the capillary member 13 from the atmospheric communication port 16. As the ink held in the capillary member 13 decreases, the water head of ink decreases and negative pressure gradually increases, but hovers within the allowable range. Even if the ink lessens, it can be supplied at stable negative pressure by the capillary force of the capillary member 13. The ink held in the capillary member 13 moves smoothly through the first meniscus formation member 18 to the communication passage 15.

In ink supply during normal print operation, air entered through the atmospheric communication port 16 attempts to enter the first meniscus formation member 18 along the side wall of the main ink chamber 12, but a very small quantity of air arrives at the surface of the first meniscus formation member 18 because it is pressed into contact with the capillary member 13 on the bottom face of the main ink chamber 12. If slight air arrives at the surface of the first meniscus formation member 18, it remains trapped on the first meniscus formation member 18 and ink continues to move. If bubbles mixed in the ink pass through the capillary member 13 and air comes in contact with the top face of the first meniscus formation member 18, it also remains trapped on the first meniscus formation member 18 and ink continues to move by setting the filter particle size of the first meniscus formation member 18 finer than that of the capillary member 13. The ink move from the main ink chamber 12 to the intermediate ink chamber 14 is made until the ink held in the capillary member 13 is almost consumed.

As maintenance operation to avoid nozzle clogging, etc., ink may be sucked from the nozzle tip in a state in which bubbles are trapped on the surface of the first meniscus formation member 18. In this case, since the ink is forcibly sucked from the nozzle tip, a larger negative pressure than usual occurs. When a large amount of ink is consumed as in printing all over, negative pressure becomes larger than usual. At such time, bubbles trapped on the surface of the first meniscus formation member 18 are pulled into the communication passage 15 together with ink through the minute holes on rare occasion. The bubbles on the first meniscus formation member 18 pulled into the communication passage 15 grow together with other bubbles, overflow the communication hole 17, and move along the slant top face of the communication passage 15 to the intermediate ink chamber 14 by the buoyant force of the bubbles, then are collected in the upper part of the intermediate ink chamber 14. If the face of the first meniscus formation member 18 on the communication passage 15 side is covered with bubbles, negative pressure is held by the surface tension of the ink interface formed in the minute holes of the first meniscus formation member 18.

When the ink held in the capillary member 13 is almost consumed, air comes in contact with the top of the first meniscus formation member 18. In this state, the minute holes of the first meniscus formation member 18 are formed with ink interface or ink meniscuses. As the ink is furthermore consumed, negative pressure gradually increases. When it exceeds the bubble point pressure of the first meniscus formation member 18, fine bubbles of air occur on the communication passage 15 side of the first meniscus formation member 18 through the ink interface or ink meniscuses formed on the first meniscus formation member 18. When the fine bubbles overflow the communication hole 17, they move along the slope of the communication passage 15 to the inside of the intermediate ink chamber 14 by the buoyant force of the bubbles. At this time, since the top face of the communication passage 15 slants, the bubbles are smoothly moved to the intermediate ink chamber 14. The bubbles moved to the intermediate ink chamber 14 remain therein gradually. The subsequent ink static pressure is controlled by the first meniscus formation member 18 and is held almost constant until ink runs out.

After the ink held in the capillary member 13 runs out, both faces of the first meniscus formation member 18 are exposed to air. That is, the main ink chamber 12 side of the first meniscus formation member 18, when the main ink chamber 12 becomes empty of ink, is exposed to air introduced through the atmospheric communication port 16. The communication passage 15 side of the first meniscus formation member 18, where a minute air layer is formed by bubbles entered via the first meniscus formation member 18, is also exposed to air. However, the ink supply section 19 sucks up the ink in the communication passage 15 to the first meniscus formation member 18 for always holding the first meniscus formation member 18 in a wet condition. Thus, the first meniscus formation member 18 is continuously formed with an ink film and the negative pressure control operation after bubbles occur is performed effectively.

If bubbles are introduced to the communication passage 15 side of the first meniscus formation member 18, they move along the slant top face of the communication passage 15 to the intermediate ink chamber 14 as described above regardless of whether the main ink chamber 12 contains ink. The bubble move direction is a direction toward the intermediate ink chamber 14 from the communication hole 17 and the move direction of ink supplied to the print head is a direction toward the joint port 21 from the communication hole 17. Since the bubble move direction and the ink move direction are opposite to each other, the ink and bubbles are reliably separated for lessening the mixing of bubbles into the print head.

Figure 7:
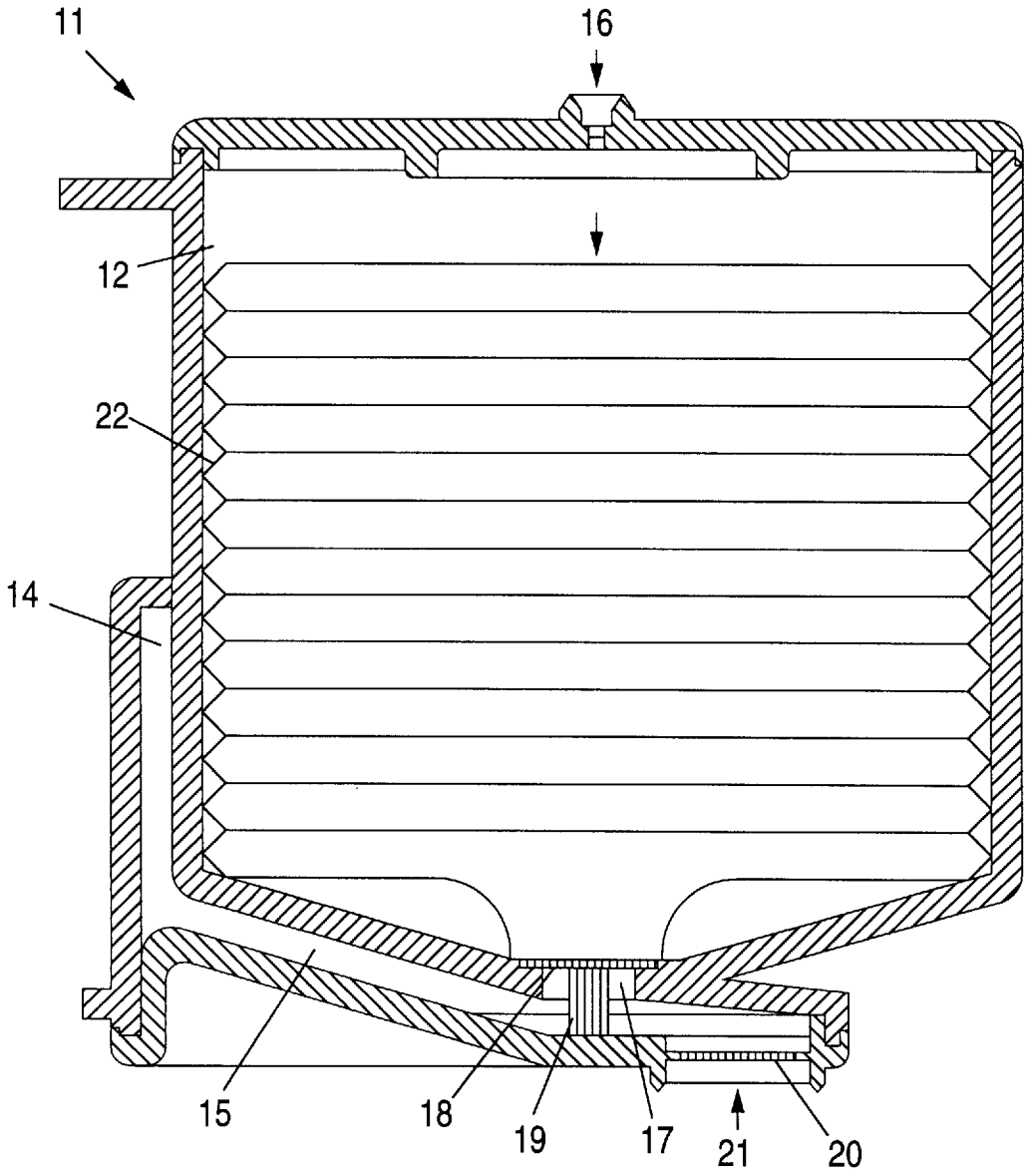
FIG. 7 is a sectional view showing a fourth embodiment of an ink supply unit of the invention.

FIG. 7 is a sectional view showing a fourth embodiment of an ink supply unit of the invention. Parts identical with or similar to those previously described with reference to FIG. 5 are denoted by the same reference numerals in FIG. 7 and will not be discussed again. In FIG. 7, numeral 22 is moving means. The fourth embodiment is provided by changing the second embodiment to a 2-chamber structure. As in the second embodiment, the moving means 22 is filled with ink and as the ink is consumed, shrinks downward. However, a force always acts in the upward expanding direction, maintaining the inside in a negative pressure condition. Although the moving means 22 shown in FIG. 7 is a sealed vessel like bellows, a sealed bag, a structure using an elastic force such as a spring, or the like can also be applied to the moving means. Also in the fourth embodiment, when an ink tank 11 is detached, a second meniscus formation member 20 prevents internal ink leakage and also prevents the entry of air into the inside. At this time, the bubble point pressure PB of the second meniscus formation member 20 is set greater than the maximum differential pressure $\Delta P_{max}$ applied to both surfaces of the second meniscus formation member 20, whereby, for example, if the ink tank 11 is left standing in an inverted position in the initial state of the ink tank 11, air does not enter the ink tank 11 from the second meniscus formation member 20.

Figure 8:
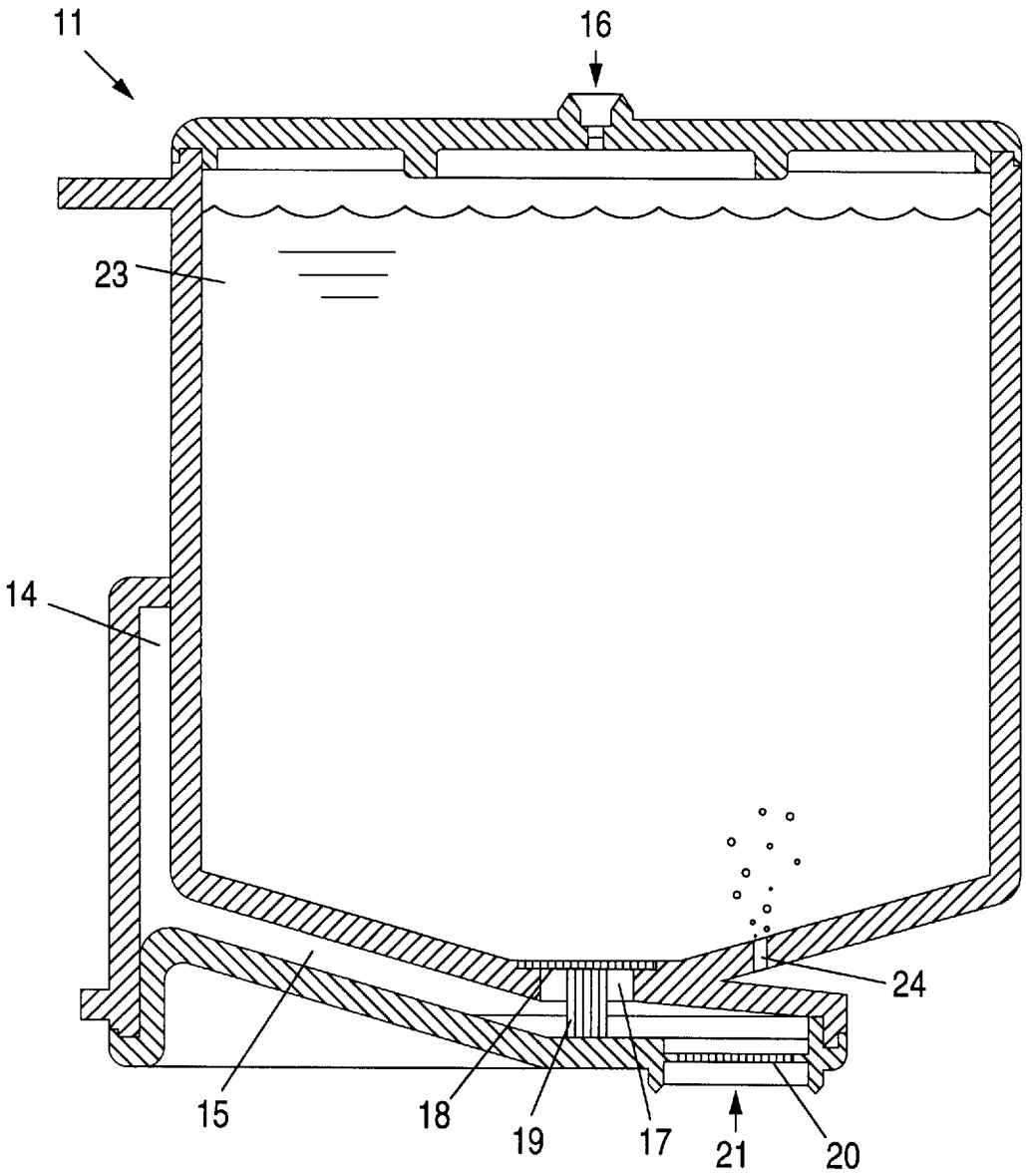
FIG. 8 is a sectional view showing a fifth embodiment of an ink supply unit of the invention.

FIG. 8 is a sectional view showing a fifth embodiment of an ink supply unit of the invention. Parts identical with or similar to those previously described with reference to FIG. 5 are denoted by the same reference numerals in FIG. 8 and will not be discussed again. In FIG. 8, numeral 23 is a main ink chamber and numeral 24 is a small hole. The embodiment shows a structure wherein the small hole 24 is used to control negative pressure in the main ink chamber 23. An ink tank 11 contains the main ink chamber 23 and an intermediate ink chamber 14 on the side thereof. The main ink chamber 23 is sealed and stores ink. The small hole 24 is made in the bottom of the main ink chamber 23. It is formed with meniscuses by the ink stored in the main ink chamber 23 for providing a bubble generator function of generating bubbles in the main ink chamber 23 by external air when the pressure in the main ink chamber 23 lowers. Thus, the bubble point pressure of the small hole 24 is determined depending on the negative pressure of the ink to be controlled.

In the fifth embodiment, since the main ink chamber 23 stores only ink, ink almost as much as 100% of the volume of the main ink chamber 23 can be stored, improving the use efficiency of the ink tank 11. To consume the ink in the ink tank 23 completely, preferably the small hole 24 is made near the lowest portion of the ink tank as much as possible.

Considering the case where the ink supply unit shown in the fifth embodiment is detached from a recorder and is left standing, the differential pressure applied to both surfaces of the second meniscus formation member 20 is the sum of negative pressure in the main ink chamber 23 and the water head of ink by the altitude difference between the first meniscus formation member 18 and the second meniscus formation member 20. The bubble point pressure of the second meniscus formation member 20 is set greater than the differential pressure, whereby air does not enter the ink tank 11 either if the second meniscus formation member 20 is pointed upward.

Figure 9:
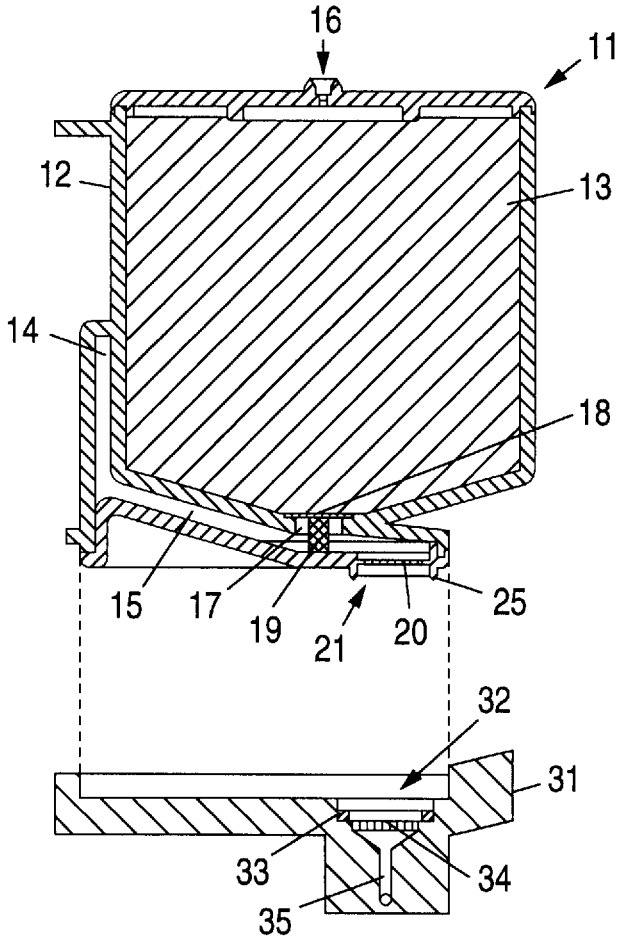
FIG. 9 is a sectional view of main parts for explaining attachment of an ink supply unit in one embodiment of a recorder of the invention.
Figure 10:
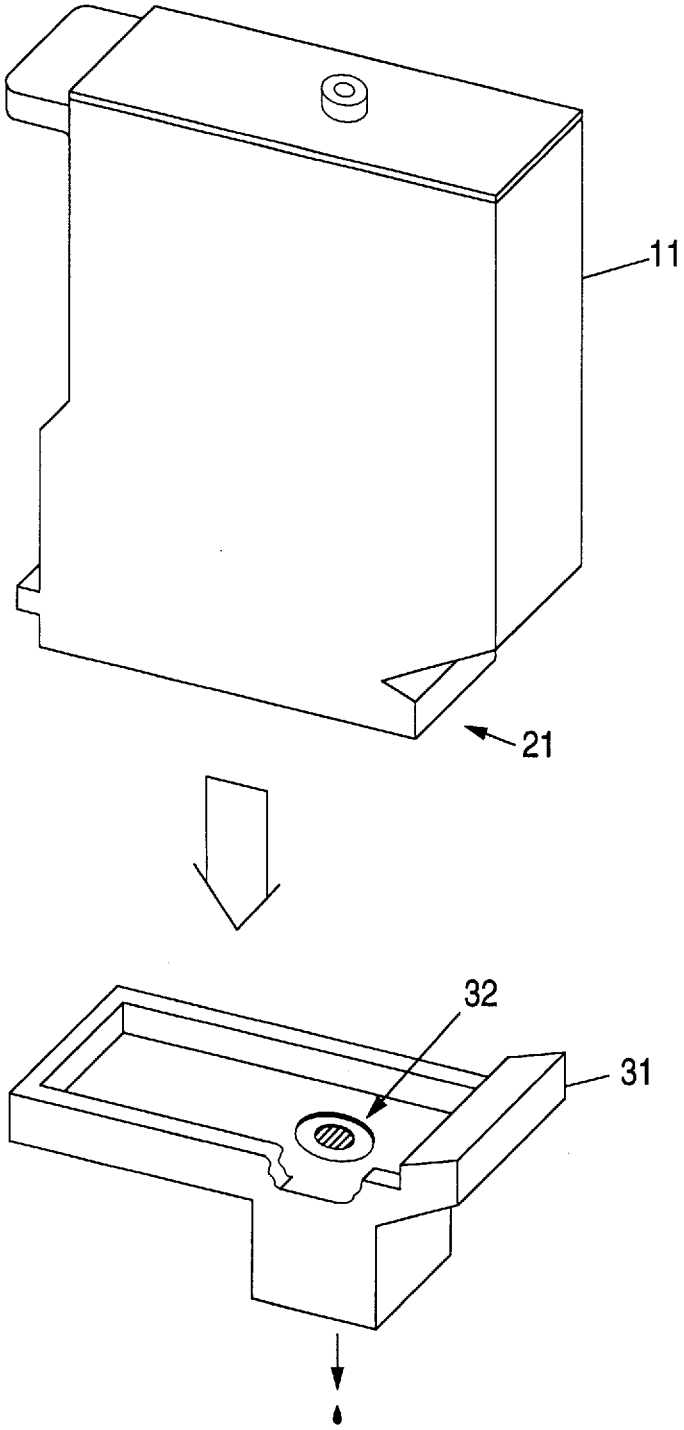
FIG. 10 is a perspective view of the main parts for explaining attachment of the ink supply unit in the embodiment of the recorder of the invention.
Figure 11:
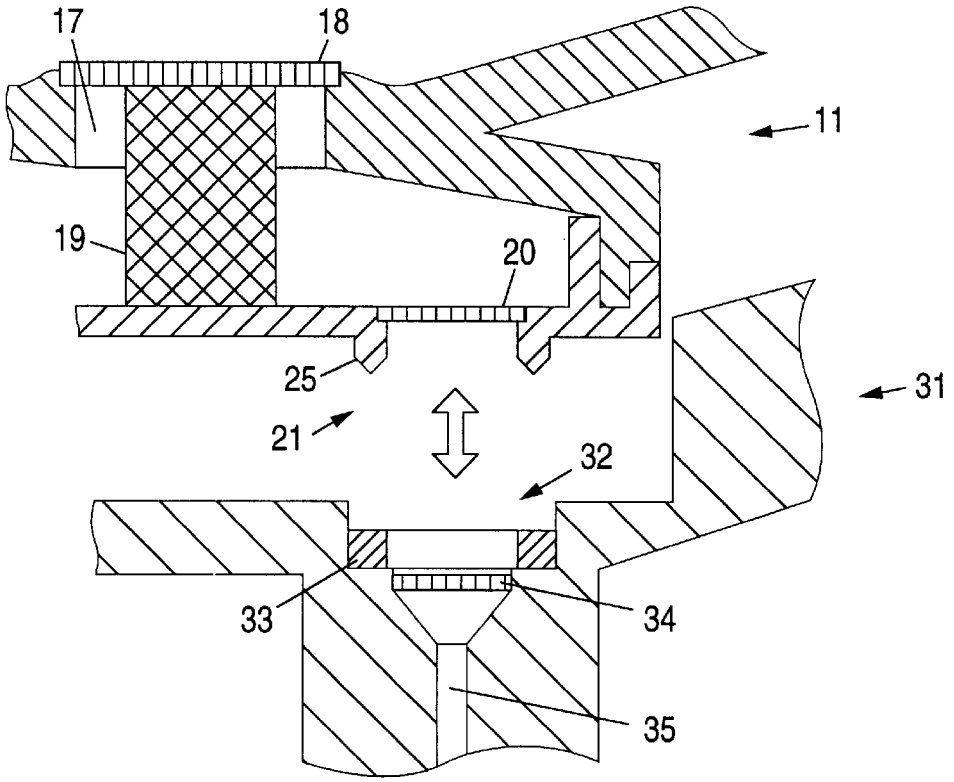
FIG. 11 is an enlarged sectional view in the vicinity of a joint port when an ink tank is detached in the embodiment of the recorder of the invention.
Figure 12:
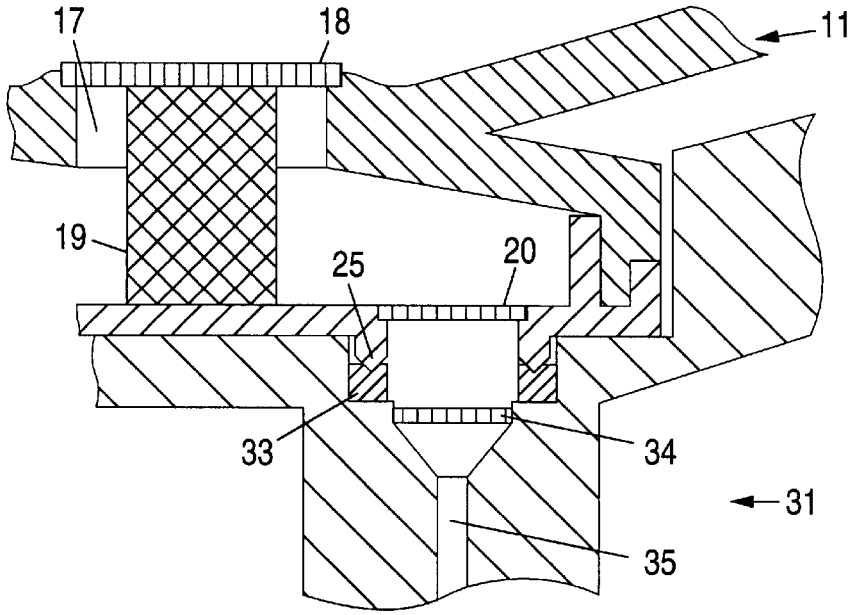
FIG. 12 is an enlarged sectional view in the vicinity of the joint port when the ink tank is attached in the embodiment of the recorder of the invention.

FIG. 9 is a sectional view of main parts for explaining attachment of an ink supply unit in one embodiment of a recorder of the invention. FIG. 10 is a perspective view of the main parts. FIG. 11 is an enlarged sectional view in the vicinity of a joint port when an ink tank is detached. FIG. 12 is an enlarged sectional view in the vicinity of the joint port when the ink tank is attached. Parts identical with those previously described with reference to FIG. 5 are denoted by the same reference numerals in FIGS. 9 to 12 and will not be discussed again. Numeral 25 is a convex part, numeral 31 is a print head, numeral 32 is an ink introduction part, numeral 33 is packing, numeral 34 is a filter, and numeral 35 is an ink flow path. FIGS. 9 to 11 show the state before an ink tank 11 is attached and FIG. 12 shows the state in which it is attached. FIGS. 9 to 12 show the structure for attaching the ink tank 11 to the print head 31 attached to a recorder, and show only the ink tank 11 and the print head 31. In the figures, the ink tank shown in the third embodiment of the ink supply unit is used, but if the ink tank shown in any other embodiment is used, the same description is also applied.

The ink tank 11 and the print head 31 are connected at the joint port 21 and the ink introduction part 32. The joint port 21 of the ink tank 11 is pressed against the ink introduction part 32 of the print head 31, thereby connecting the ink flow path for supplying ink from the ink tank 11.

The print head 11 is connected at the ink introduction part 32 to the joint port 21 of the ink tank 11. The joint port 21 of the ink tank 11 has an outer peripheral part formed with the convex part 25. For example, the doughnut-shaped rubber packing 33 is placed in the ink introduction part 32 corresponding to the convex part 25. As shown in FIG. 12, the convex part of the joint port 21 is pressed by the packing 33, thereby sealing the ink flow path for preventing ink leakage in the portion. It is desirable to use a material resistant to used ink for the packing 33; specifically, a product of hardness 30 of silicon rubber or butyl rubber, or the like can be used.

The filter 34 is placed on the ink flow passage 35 from the ink introduction part 32 to a nozzle so as not to mix dust, etc., deposited on the ink introduction part 32 with the ink tank 11 detached into the ink flow path 35. For example, a stainless mesh filter having the filter particle size of 10 to 60 microns or the like can be used as the material of the filter 34. For example, a ceramic filter can also be used for the filter 34. Specifically, a stainless mesh filter having the filter particle size of 20 microns can be used.

Figure 13:
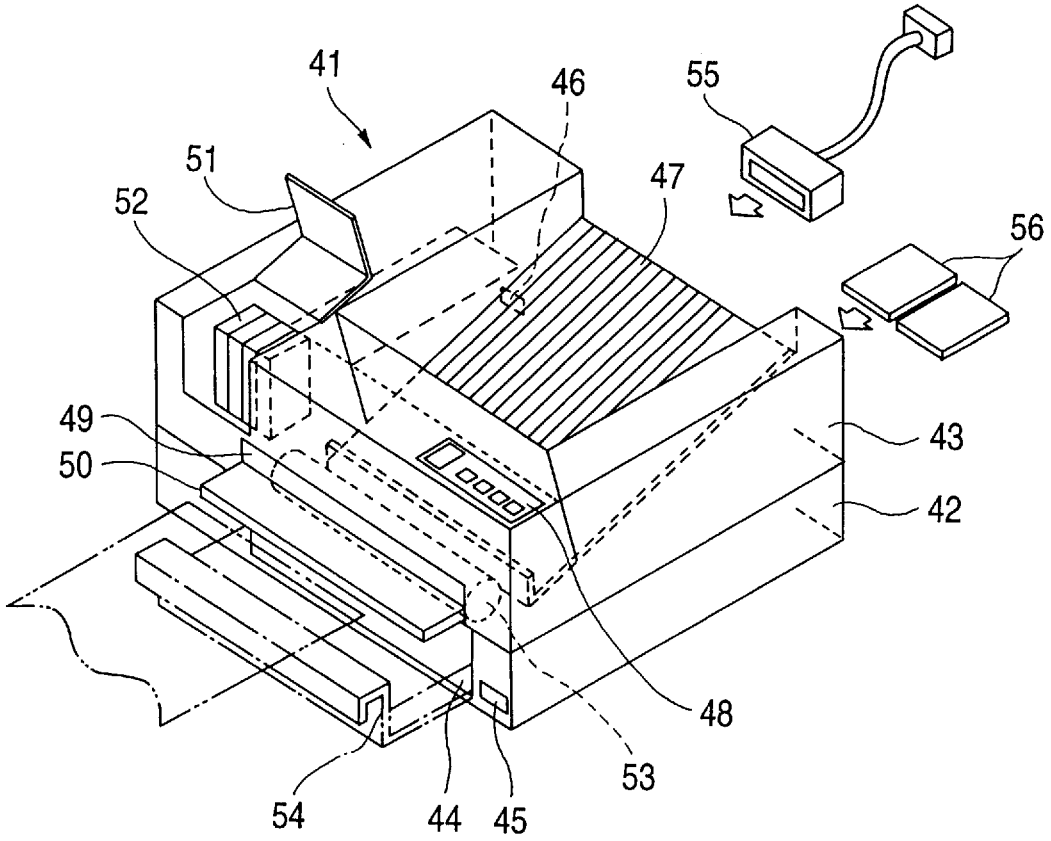
FIG. 13 is an external view in one embodiment of a recorder of the invention.

FIG. 13 is an external view in one embodiment of a recorder of the invention. In the figure, numeral 41 is a recorder, numeral 42 is a lower case, numeral 43 is an upper case, numeral 44 is a tray insertion slot, numeral 45 is a dip switch, numeral 46 is a main switch, numeral 47 is a paper receptacle, numeral 48 is a panel console, numeral 49 is a manual insertion slot, numeral 50 is a manual tray, numeral 51 is an ink tank insertion lid, numeral 52 is an ink tank, numeral 53 is a paper feed roller, numeral 54 is a paper tray, numeral 55 is an interface cable, and numeral 56 is memory cards. FIG. 13 shows the whole of the recorder to which the first to fifth embodiments of the ink supply unit are applied.

A cabinet of the recorder 41 mainly consists of the upper case 42 and the lower case 43, wherein electric circuitry, drive parts, etc., (not shown) are housed. The lower case 42 is provided with the tray insertion slot 44 through which the paper tray 54 storing record paper is inserted for loading paper into the recorder 41.

The dip switch 45 and the main switch 46 are fitted to the lower case 42. The dip switch 45 is used to set a part of the operation of the recorder 41 and is assigned function settings less frequently changed. When not used, the dip switch 45 is covered with a cover. The main switch 46 is a switch for turning on and off the power of the recorder 41. The lower case 42 is further provided with insertion slots of an interface connector (not shown), the memory cards 56, etc. The interface cable 55 is connected to the interface connector for transferring data to and from an external computer, etc. The memory card 56 is used as an extended memory when the recorder 41 operates; it may store font for use at the recording time.

The upper case 43 is formed with the paper receptacle 47 for discharging recorded paper. It is also provided with the panel console 48 comprising input means frequently used for the user to set a record mode and give commands of paper feed, paper discharge, etc., display means of messages from the recorder, and the like. Further, the manual insertion slot 49 and the manual tray 50 are provided, enabling the user to manually feed paper from here.

The upper case 43 is also provided with the ink tank insertion lid 51. The user can attach or detach the internal ink tank 52 by opening the lid. The ink tanks 52 of the structures as shown in the embodiments discussed above can be used. In FIG. 13, four ink tanks 52 are attached. Each ink tank 52 is attached to a record head (not shown), as shown in FIGS. 9 to 12. The record head is fitted to a carriage (not shown).

Sheets of paper stored on the paper tray 54 are taken out one by one and transported by an internal transport system (not shown) and fed along the circumference of the paper feed roller 53. The record head (not shown) to which the ink tank 52 is attached moves in a direction perpendicular to the paper transport direction for recording data for each strip area. The sheet of paper is fed to the record position of the next strip area in the length direction of the sheet by the paper feed roller 53. This operation is repeated for recording data on the sheet. Then, the sheet is discharged to the paper receptacle 47 of the upper case 43.

Although the ink tank 11 is attached to the print head 31 in the embodiment of the recorder, for example, the print head 31 may also be made detachable from the carriage of the recorder and the ink tank 11 may be attached to the carriage.

As seen in the description made so far, according to the invention, the bubble point pressure of the meniscus formation member disposed at the exit of the ink storage means to a print head is set so as to satisfy a predetermined relation, whereby both ink leakage from the meniscus formation member and air suction from the outside can be prevented. Thus, recorder contamination occurring when the ink supply unit is detached from the print head and recovery operation caused by air suction can be reduced, providing a highly reliable record head separation type ink tank and a recorder using the ink tank.

What is claimed is:

1. An ink supply unit, comprising:

a storage member for storing ink in a negative pressure condition;

an exit communicating with said storage member for supplying ink to an outside, and;

a meniscus formation member disposed on said exit;

wherein when negative pressure generated by said storage member is PR, bubble point pressure of said meniscus formation member is PB, a water head of ink acting on a storage member side surface of said meniscus formation member is PH, and an inward differential pressure acting on both surfaces of said meniscus formation member is ΔP, $\Delta P = PR + PH$ and relation $PB > \Delta P$ is satisfied.

2. The ink supply unit of claim 1, wherein said storage member includes a porous member for generating the negative pressure by a capillary force of said porous member.

3. The ink supply unit of claim 1, wherein said storage member includes a housing and a bubble generator disposed in said housing for generating the negative pressure by bubble point pressure of said bubble generator.

4. The ink supply unit of claim 1, wherein said storage member includes a moving member for storing ink, said moving member operating so as to maintain internal negative pressure.

5. The ink supply unit of claim 1, wherein said exit is engageable with a print head and is capable of being sealed so that liquid cannot pass through the exit.

6. The ink supply unit of claim 1, wherein said meniscus formation member is selected from the group of a mesh substance, a filter of a fabric, resin fiber, and a filter having a highly precise opening diameter.

7. The ink supply unit of claim 1, wherein the bubble point pressure of said meniscus formation member is set so as to satisfy relation PB≧PR+PH.

8. The ink supply unit of claim 2, wherein said porous member is selected from the group of a fiber material having a two-dimensional structure, a porous material having a three-dimensional structure, a felt comprising a fiber material spun into a three-dimensional form, and a nonwoven cloth material.

9. The ink supply unit of claim 2, wherein said porous member is made of polyester felt, a density thereof ranging from 0.06 g/cm$^3$ to 0.1 g/cm$^3$.

10. The ink supply unit of claim 1, wherein said meniscus formation member is an SUS tatami twill filter having a filter particle size ranging 5 μm to 60 μm or so.

11. An ink recorder, comprising:

a main ink chamber having an atmospheric communication port communicating with an external atmosphere, a communication hole for supplying ink, and a first meniscus formation member being disposed on said communication hole and formed with minute holes, said main ink chamber being capable of storing ink in a negative pressure condition;

a secondary ink chamber being sealed and having a joint part communicating with said communication hole and a second meniscus formation member being disposed on said joint part and formed with minute holes; and a print head connected to said joint part for spouting ink, wherein when negative pressure generated in said main ink chamber is PR, bubble point pressure of said second meniscus formation member is PB, and a water head of ink acting on a main ink chamber side surface of said first meniscus formation member is PH, relation PB≧PR+PH is satisfied.

12. The ink recorder of claim 11, wherein said main ink chamber includes a porous member for generating the negative pressure by a capillary force of said porous member.

13. The ink recorder of claim 11, wherein said meniscus formation member is a fabric.

14. The ink recorder of claim 11, wherein the bubble point pressure of said meniscus formation member is set so as to satisfy relation PB≧PR+PH.

15. A recorder comprising a print head and an ink supply unit each with a joint part enabling them to be separated, wherein said ink supply unit, comprises:

a storage member for storing ink in a negative pressure condition;

an exit communicating with said storage member for supplying ink to an outside; and a meniscus formation member disposed on said exit;

wherein when negative pressure generated by said storage member is PR, bubble point pressure of said meniscus formation member is PB, a water head of ink acting on a storage member side surface of said meniscus formation member is PH, and an inward differential pressure acting on both surfaces of said meniscus formation member is ΔP, ΔP=PR+PH and relation PB>ΔP is satisfied.

16. The recorder of claim 15, wherein said storage member includes a porous member for generating the negative pressure by a capillary force of said porous member.

17. The recorder of claim 15, wherein said meniscus formation member is selected from the group of a mesh substance, a filter of a fabric, resin fiber, and a filter having a highly precise opening diameter.

18. The recorder of claim 15, wherein the bubble point pressure of said meniscus formation member is set so as to satisfy relation PB≧PR+PH.

19. The ink supply unit of claim 16, wherein said porous member is selected from the group of a fiber material having a two-dimensional structure, a porous material having a three-dimensional structure, a felt comprising a fiber material spun into a three-dimensional form, and a nonwoven cloth material.

20. The recorder of claim 16, wherein said porous member is made of polyester felt, a density thereof ranging from 0.06 g/cm$^3$ to 0.1 g/cm$^3$.

21. The recorder of claim 15, wherein said meniscus formation member is an SUS tatami twill filter having a filter particle size ranging 5 μm to 60 μm or so.

22. An ink supply unit, comprising:

a storage member for storing ink in a negative pressure condition;

an exit disposed downward and communicating with said storage member for supplying ink to an outside;

a meniscus formation member disposed on said exit; and a bubble point pressure PB of said meniscus formation member being set so that when the ink supply unit is inverted and negative pressure generated by said storage member is PR, a maximum water head of ink acting on a storage member side surface of said meniscus formation member is $PH_{max}$, and a maximum inward differential pressure acting on both surfaces of said meniscus formation member is $\Delta P_{max}$, wherein $\Delta P_{max} = PR + PH_{max}$ and a relation $PB > \Delta P_{max}$ is satisfied.

23. A recorder comprising a print head and an ink supply unit each with a joint part enabling them to be separated, said ink supply unit, comprising:

a storage member for storing ink in a negative pressure condition;

an exit disposed downward and communicating with said storage member for supplying ink to an outside;

a meniscus formation member disposed on said exit; and a bubble point pressure PB of said meniscus formation member being set so that when said ink supply unit is inverted and separated from said print head, and negative pressure generated by said storage member is PR, a maximum water head of ink acting on a storage member side surface of said meniscus formation member is $PH_{max}$, and a maximum inward differential pressure acting on both surfaces of said meniscus formation member is $\Delta P_{max}$, wherein $\Delta P_{max}=PR+PH_{max}$ and a relation $PB>\Delta P_{max}$ is satisfied.

* * * * *